US005485936A

United States Patent [19]

Sato

[11] Patent Number: 5,485,936

[45] Date of Patent: Jan. 23, 1996

[54] SEALING PLATE WITH A FILTER FOR A HIGH PRESSURE LIQUIFIED GAS CARTRIDGE HAVING A SYPHON TUBE

[75] Inventor: Masao Sato, Koshigaya, Japan

[73] Assignee: Nippon Tansan Gas Company Limited, Tokyo, Japan

[21] Appl. No.: 255,301

[22] Filed: Jun. 8, 1994

Related U.S. Application Data

[63] Continuation of Ser. No. 6,617, Jan. 21, 1993, abandoned.

[30] Foreign Application Priority Data

Jan. 20, 1992 [JP] Japan ..... 4-027473

[51] Int. Cl.[6] ..... B65D 51/16

[52] U.S. Cl. ..... 220/371; 215/364; 55/421

[58] Field of Search ..... 220/371, 373, 220/901; 215/364, 248; 55/385.4, 421

[56] References Cited

U.S. PATENT DOCUMENTS 3,507,098 4/1970 Veres et al. ..... 55/421 X 4,032,311 6/1977 Bohmrich et al. ..... 55/385.4

*Primary Examiner*—Jes F. Pascua

*Attorney, Agent, or Firm*—Lackenbach Siegel Marzullo Aronson & Greenspan

[57] ABSTRACT

A sealing plate for sealing a cartridge containing a liquified gas under pressure and having a neck with an opening with a syphon tube thereof extending from the neck into the cartridge has mounted on a side surface thereof a powdered metal cylindrical filter having a blind bore with open end closed by the plate. An integral annulus centrally disposed on the plate and projecting outwardly from a side surface of the plate mounts the filter in fixed assembly with the sealing plate. The filter is press-fitted into the annulus with its open end against the plate so that an annulus inner cylindrical surface is circumferentially disposed about the open end of the cylinder. The plate is mounted in use on the neck closing it. The cylindrical filter and the annulus around it extend into the neck and the marginal peripheral surface portion of the plate around the annulus overlies the neck closing its opening and is welded thereto to effect a seal. The sealing plate is made of a pierceable material which is pierced, when the cartridge is mounted for use in a system, to provide communication between the opening formed and the closed bore of the cylindrical filter so that a filtered liquidified gas outflow from the filter is established.

2 Claims, 1 Drawing Sheet

SEALING PLATE WITH A FILTER FOR A HIGH PRESSURE LIQUIFIED GAS CARTRIDGE HAVING A SYPHON TUBE

This application is a continuation, of application Ser. No. 08/006,617, filed Jan. 21, 1993, now abandoned.

BACKGROUND OF THE INVENTION

1. Field of the Invention

The present invention relates to a sealing plate with a filter for a high pressure liquified gas cartridge having a syphon tube.

2. Description of the Prior Art

A cartridge of the type having a double safety device which regulates the quantity of flow of high pressure gas to prevent a cartridge from flying off (like a missile) by reaction and being fixed with a filter on a sealing plate for preventing an orifice from being clogged, has been shown in No. 61-274200 (FIG. 8) and also No. 62-17500 of Japanese Publications, both of which were filed prior to the present application.

A high pressure gas cartridge to which the aforesaid filter is applied, and the cartridge is only charged with a perfectly gasified high pressure gas. Therefore, there are rare cases where cutting dusts and the like remain in a cartridge and moreover, as a flowing substance in the cartridge is a perfectly gasified high pressure gas only, the cutting dusts and the like which are carried by the gas are limited to those which float and slightly stick to the inner wall of the cartridge, and the total quantity thereof is trifling.

On the contrary, in a case of a cartridge to be charged with a liquified gas, the fitted on the portion of a cartridge.

Therefore, by friction between the outer circumferential plane of a syphon tube and the inner wall of a cartridge, micro particles and/or dust are apt to stick to the connecting portion and the like between the outer periphery of the top plane of the syphon tube and the cartridge.

As liquid has a flowing resistance greater than that of gas, when liquid moves in a cartridge, the liquid takes with it these dusts therein. When the liquid flows out of a cartridge, the liquid carries these dusts therewith, and which often causes a clogging of a filter provided on a valve. In such a case, a desired quantity of gas flow becomes unobtainable. Furthermore, in various valve filters, there are those types which are not replaceable or are difficult to replaced, therfore, long and stable use of a filter is most desirable.

It might be thought that it would be good to wash a cartridge after a syphon tube has been utilized, but, in fact, washing a cartridge after the setting of a syphon tube has not been done. That is why, even if a cartridge is washed, when the cartridge is inclined to drain the washing, a large portion of the washings does not flow out and remains in the cartridge, thus the dusts and like cannot be drained.

Accordingly, in a sealing plate and filter combination for a high pressure liquified gas cartridge having a syphon tube, it has been a difficult problem to prevent inner dusts and the like from flowing out.

The present invention solves the problem, by fitting a filter, which is formed like a column or cylinder, having a blind bore which has an opening at one end in the axial direction thereof, onto the main body or sealing plate, by directing said opening of the cylinder to the inner surface of the sealing plate and positively fitting an outer circumferential surface of said filter onto an integral inner circumferential surface of an annulus on the main body or sealing plate.

A sealing plate of the present invention is placed on and over a neck opening of a cartridge with a syphon tube and liquified gas, such as liquified carbon dioxide gas, is charged therein. Then, the sealing plate is welded to the cartridge.

When the cartridge is attached to an opening device and the sealing plate is pierced, the liquified gas flows in the syphon tube, passes through the filter, and flows out of the cartridge. Quantity of flow of the liquified gas is not restrained by the filter. The liquified gas from a valve is supplied to works requiring same, such as washing or cooling of an electronic circuit.

The dust and like particles, which have passed through the syphon tube with the liquified gas, are caught by the filter when they pass therethrough, and only purified gas flows in the valve. Therefore, the, filter, which is provided on the valve, is not clogged in almost all cases, and an expensive valve can be used for long periods of time and is very stable.

SUMMARY OF THE INVENTION

It is an object of the present invention to provide a sealing plate with a filter for a high pressure liquified gas cartridge having a syphon tube, which, by purifying liquified gas even if cutting dusts and the like are taken therein, can supply only purified liquified gas to a demand side through a valve.

Another object of the present invention is to provide a filter which is not deformed or broken even if a difference arises in pressures between an inner side of a cartridge and a flowing out side of a valve and which can supply normally liquified gas.

Other and further objects of the present invention will be readily apparent from the following description of preferred embodiments with reference to the accompanying drawings.

DETAILED DESCRIPTION OF THE INVENTION

Figure 1:
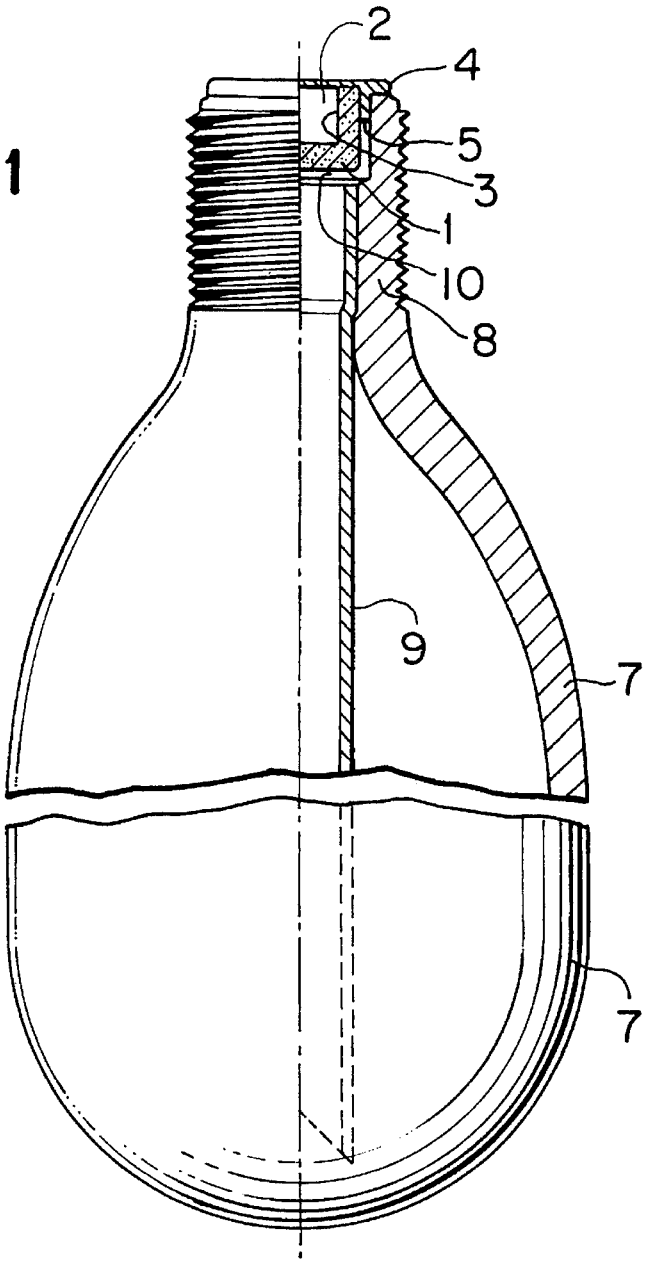
FIG. 1 is a side view, partly in section and broken away, of an embodiment of a high pressure liquified gas cartridge with a syphon tube, and a sealing plate made according to the invention.
Figure 2:
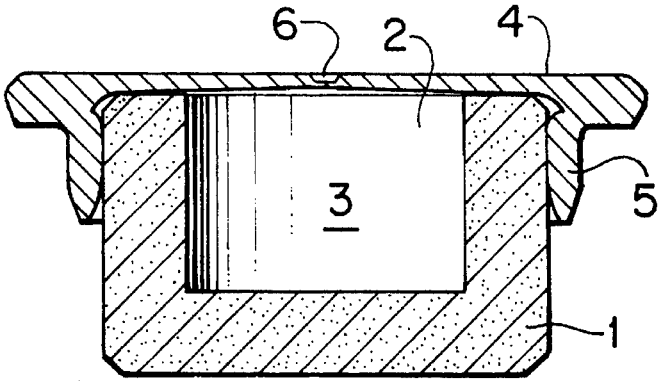
FIG. 2 is an enlarged sectional view of the sealing plate and filter combination.

Element 1 is a filter and is formed of metallic powder in a cylindrical shape have a blind bore 3 with an opening 2 at one end in an axial direction. If stainless steel powder for making the filter is used as the metallic powder, corrosion resistance is increased.

A plate 4 has an integral annulus 5 on one side surface and a safety device 6 is provided on the other side surface.

The filter 1 is attached to the plate 4, by directing its opening 2 of the blind bore 3 to face to the inner side surface of the plate 4 and by press-fitting the outer periphery of the filter 1 into the inner circumferential surface of the integral annulus 5.

In the cylindrical filter, the blind bore 3 defines a space inside the filter closed by the sealing plate 4, and the space enables movement of a needle, for example of a valve, to pierce the plate 4.

The reference numeral 7 is a cartridge, and, in the inner bore of a neck 8 of which the upper portion of a syphon tube 9 made of metal or plastic fits, and also the lower portion of the syphon tube extends to near the bottom of the cartridge 7.

As usual, the outer underside or peripheral portion of the main body or sealing plate 4 is put on top of an opening portion 10 of the cartridge 7 and liquified gas is charged in the cartridge 7. Then the sealing plate 4 and the cartridge 7 are welded to each other, and the opening portion 10 is sealed.

After the neck 8 of the cartridge 7 has been attached to an opening device which, as usual, is provided to a valve, the main body 4 is pierced. The liquified gas flows up in the syphon tube 9 and flows out, controlled by the valve, to the demand side.

When liquified gas is charged in a cartridge and the cartridge is vibrated during its transportation, some of dusts, such particles as metallic or plastic powder, which stick to an end portion between the syphon tube 9 and the neck 8, are taken into the liquified gas. The dust and/or particles also flow up in the syphon tube 9 carried by the gas, but, as the mesh size of the filter 1 is less than the dust particles, the dust cannot pass through the filter and are caught thereby. Thus, only purified liquified gas flows in a valve, and the filter which is provided for the valve is not clogged.

The purified liquified gas flow is controlled by a valve and used for cleaning or cooling a semiconductor.

Although the present invention has been described in some detail by way of illustration and example for purposes of clarity and understanding, it will, of course, be understood that various arrangements of the parts without departing from the scope of the invention as set forth in the following claims.

What I claim are:

1. A sealing plate and filter combination sealing a cartridge containing a liquified gas content under pressure and having a neck with an opening and a syphon tube extending from said neck internally of the cartridge; said sealing plate comprising;

a plate, having a side surface with an annular mounting bracket in fixed assembly with a powdered metal cylindrical filter, said filter having a blind bore with one end open and being disposed on the side surface mounting bracket of said plate and said open end being closed by said side surface of said plate so that an interior space in the filter is defined by the bore of the filter and said plate;

said side surface having an integral annulas centrally disposed thereon and projecting therefrom and into which said filter is pressed as fitted fixedly assembling the filter to said plate with an inner cylindrical surface of said annular disposed circumferentially of the cylindrical filter;

said side surface having a peripheral marginal portion circumferentially of said integral annular centrally disposed thereon;

said plate being mountable in use with the peripheral marginal portion overlying said neck and being sealed thereto and closing the neck opening; and said filter with said integral annular circumferentially of the filter extending into said neck toward the syphon tube enabling the outflow of said liquified gas content of the cartridge via said syphon tube and said filter into said interior space of the filter; and said sealing plate consisting of a pierceable material to selectively provide an opening thereon in communication with the interior space of the filter to provide a filtered outflow of the liquified gas content from said cartridge when the cartridge is mounted on a system.

2. A sealing plate and filter combination according to claim 1, in which the filter powdered metal is stainless steel.

* * * * *